US005318689A

United States Patent [19]

Hsing et al.

[11] Patent Number: 5,318,689

[45] Date of Patent: Jun. 7, 1994

[54] HEAVY NAPHTHA CONVERSION PROCESS

[75] Inventors: Hsu-Hui Hsing, Nederland; Roy E. Pratt, Port Neches, both of Tex.

[73] Assignee: Texaco Inc., White Plains, N.Y.

[21] Appl. No.: 976,771

[22] Filed: Nov. 16, 1992

[51] Int. Cl.[5] ..... C10G 69/08; C10G 57/00; C07C 107/00

[52] U.S. Cl. ..... 208/70; 208/308; 585/322; 585/330

[58] Field of Search ..... 208/146, 70, 308

[56] References Cited

U.S. PATENT DOCUMENTS

| | | | |
|---|---|---|---|
| 3,514,488 | 5/1970 | Uebele et al. | 208/308 |
| 4,049,539 | 9/1977 | Yan et al. | 208/49 |
| 4,437,976 | 3/1984 | Oleck et al. | 208/49 |
| 4,647,368 | 3/1987 | McGuiness et al. | 208/70 |
| 4,950,387 | 8/1990 | Harandi et al. | 208/70 |
| 5,062,943 | 11/1991 | Apelian et al. | 208/49 |

*Primary Examiner*—David B. Springer

*Attorney, Agent, or Firm*—James L. Bailey; Kenneth R. Priem; Richard A. Morgan

[57] ABSTRACT

A straight run naphtha is fractionated to yield on intermediate naphtha and the heaviest 10 vol % as heavy naphtha. The intermediate naphtha is catalytically reformed to yield reformed naphtha having a 90 vol % temperature (T90) of 310° F. (155° C.). The heavy naphtha is subjected to fluid catalytic cracking (FCC) to yield liquid fuel and lighter, including $C_4$ olefins and a cracked naphtha having a research octane number suitable for gasoline blending.

16 Claims, No Drawings

HEAVY NAPHTHA CONVERSION PROCESS

BACKGROUND OF THE INVENTION

1. Field Of The Invention

The invention is a catalytic process for converting crude petroleum fractions to gasoline. More particularly the invention is a process for converting petroleum fractions by both fluid catalytic cracking (FCC) and catalytic reforming.

2. Description Of Related Methods In The Field

In the fluid catalytic cracking (FCC) process a petroleum derived hydrocarbon charge stock is contacted with hot regenerated catalyst in a reaction zone. The charge stock is converted by cracking to lower boiling hydrocarbons and coke. The lower boiling hydrocarbon vapor and spent catalyst are separated in a containment vessel, termed in the art the reactor vessel. Separated spent catalyst is steam stripped of entrained vapor and the remaining spent catalyst coated with a layer of unstrippable coke is passed from the reactor vessel to a catalyst regenerator vessel. There, spent catalyst is regenerated by controlled oxidation of the coke coating to carbon dioxide and carbon monoxide. An active regenerated catalyst, substantially free of coke is thereby produced.

Separated lower boiling hydrocarbon vapor, stripped vapor and spent stripping steam is withdrawn from the reactor vessel and passed to a fractionation train where cracked hydrocarbon vapors are separated by fractional distillation into the desired intermediate fractions. Any number of intermediate fractions can be made based on refinery configuration and product demand. For example, product fractions may include a gaseous fraction, naphtha, kerosene, diesel oil, gas oil and vacuum gas oil. Of these fractions, the naphtha fraction is the most desirable because of its use as an automobile fuel blending stock after further processing. The intermediate fractions comprising naphtha, kerosene and diesel oil may be used for their fuel value. In the alternative they may be processed to produce additional naphtha suitable for blending into gasoline. The heavy fractions comprising gas oil and vacuum gas oil may be used for the production of heavy fuel oil. A portion of the heavy fraction may optionally be recycled to the fluid catalytic cracking reaction zone to produce additional lower boiling hydrocarbons, including an additional increment of gasoline.

U.S. Pat. No. 4,422,925 to D. Williams et al. teaches a process for the fluid catalytic cracking (FCC) of a plurality of hydrocarbon feedstocks. In the process a gaseous paraffinic hydrocarbon is used as a lift gas to fluidize a cracking catalyst in a riser (transfer line) reactor. Naphtha and gas oil feedstocks are cracked to yield liquid fuels.

Catalytic reforming is a process for converting crude petroleum fractions to high octane naphtha suitable for blending in gasoline. Feedstocks for the catalytic reforming process are typically straight run naphthas from crude petroleum which have been subjected to hydrodesulfurization. Catalytic reforming reactions include dehydrogenation, isomerization and hydrocracking. The dehydrogenation reactions typically include the dehydroisomerization of alkylcyclopentanes to aromatics, the dehydrogenation of paraffins to olefins, the dehydrogenation of cyclohexanes to aromatics, and the dehydrocyclization of paraffins and olefins to aromatics. The conversion of cyclic paraffins and n-paraffins to aromatics is most important because of the high octane of the resulting aromatic product compared to the low octane of the n-paraffin feedstock. The isomerization reactions include isomerization of n-paraffins to isoparaffins, the hydroisomerization of olefins to isoparaffins, and the isomerization of substituted aromatics. Hydrogenation reactions include the hydrocracking of paraffins and hydrodesulfurization of residual sulfur compounds remaining in the feedstock.

SUMMARY OF THE INVENTION

The invention is a process for separating a straight run naphtha into heavy and intermediate naphtha fractions, and catalytically cracking the heavy naphtha fraction to produce a $C_3$–$C_5$ olefin fraction and a cracked naphtha fraction. The intermediate naphtha is catalytically reformed to produce a reformed naptha having 90 vol % boiling at a temperature of 310° F. (155° C.) or lower.

A crude petroleum is subjected to fractionation to yield two essential fractions. The first is a straight run naphtha fraction having a boiling range of about 90° F. (32.2° C.) to 430° F. (221° C.). The second is a gas oil and vacuum gas oil fraction having a boiling range of about 650° F. (343° C.) to 1100° F. (593° F.).

The straight run naphtha fraction is fractionated to produce at least two essential fractions. The first fraction is an intermediate naphtha fraction. The end point of the intermediate naphtha is coincident with the initial boiling point of the second fraction a heavy naphtha fraction. The heavy naphtha fraction has an initial boiling point of about 250° F. (121° C.) or higher.

The heavy naphtha fraction is heated and entirely vaporized to yield a lift gas. A regenerated fluid catalytic cracking (FCC) catalyst is contacted with the lift gas in an initial portion of the vertically elongated riser reactor to produce an upwardly flowing catalyst suspension. The catalyst suspension is contacted with the gas oil and vacuum gas oil fraction at a riser reactor catalytic conversion temperature of about 900° F. (482° C.) to 1200° F. (649° C.) to yield a liquid fuel and lighter fraction. The liquid fuel and lighter fraction is fractionated to yield a $C_3$, $C_4$ and $C_5$ olefin fraction and a cracked naphtha fraction.

The intermediate naphtha fractions are subjected to catalytic reforming to yield naphtha characterized in having 90 vol % boiling at a temperature of 310° F. (155° C.) or less.

DETAILED DESCRIPTION OF THE INVENTION

Feedstock for the process is crude petroleum. The source of the crude petroleum is not critical; however, Arabian light and West Texas intermediate are preferred feedstocks in the petroleum refining industry because these petroleums are rather light and have a relatively low viscosity compared with other whole crude petroleums. The viscosity of Arabian light petroleum is about 10 cp at 280° F. with a gravity of about 34.5° API. Other whole crude petroleum having a gravity of between about 33° API and 36° API are preferred and are considered premium grade because of their moderate gravity. In general crude petroleums having a gravity of 30° API and higher are desirable. Crude petroleums having a gravity of 20° API and lower are less desirable though they may be used as feedstocks to produce naphtha for the process.

Crude petroleum is subjected to a first cleaning process to remove water and salts as well as salt, clay, drilling mud, rust, iron sulfide and other matter commonly carried along with the material. Inorganic matter is removed by techniques well-known in the art. In a desalting process, crude petroleum is intimately mixed with salt free water. The crude petroleum and water are then separated with emulsion breaking techniques and a salt free petroleum recovered.

Salt free petroleum is subjected to fractional distillation in fractional distillation towers including a pipe still and a vacuum pipe still with lesser associated distillation towers. The resulting fractions range from the lightest hydrocarbon vapors including methane, ethane, ethylene, propane and propylene to the heaviest vacuum resid having an initial boiling point of 1100° F. (593° C.). Intermediate between propane and propylene and the heavy vacuum resid fractions are a number of intermediate fractions. The cut points of each of these intermediate fractions is determined by refinery configuration and product demand. These intermediate fractions include naphtha, kerosene, diesel oil, gas oil and vacuum gas oil. Each of these fractions which is taken directly from the fractional distillation of crude petroleum is referred to in the art as "straight run." Applicants adopt this convention and by definition, intermediate fractions referred to as "straight run" are the direct product of fractional distillation of crude petroleum and have not been subjected to subsequent conversion such as catalytic or thermal conversion processes.

In response to refinery configuration and product demand a large body of technology has been developed for the conversion of one intermediate fraction to another. Straight run fractions differ from converted fractions particularly in the distribution of substituent components in the fraction. Typically they are higher in olefins, naphthenes and aromatic compounds as an artifact of catalytic or thermal processing. For example straight run naphtha is high in paraffins and low in olefins compared with naphthas derived from reforming or conversion processes.

According to the invention a crude petroleum is subjected to atmospheric and vacuum distillation to produce straight run intermediate distillate fractions. These include naphtha, kerosene, diesel oil, gas oil and vacuum gas oil. These intermediate distillate fractions may be generally described as having an initial boiling point of about 90° F. or 32° C. ($C_5$) and having an end point of about 950° F. (510° C.) depending on the crude petroleum source.

Traditionally gasoline has had a boiling range of 90° F. or 32° C. ($C_5$) to 430° F. (221° C.). Naphtha has a boiling range of 90° F. (32° C.) to 430° F. (221° C.). Kerosene has a boiling range of 360° F. (182° C.) to 530° F. (276° C.). Diesel has a boiling range of 360° F. (182° C.) to about 650° F.-680° F. (343° C.-360° C.). The end point for diesel is 650° F. (343° C.) in the United States and 680° F. (360° C.) in Europe. Gas oil has an initial boiling point of about 650° F.-680° F. (343° C.-360° C.) and end point of about 800° F. (426° C.). The end point for gas oil is selected in view of process economics and product demand and is generally in the 750° F. (398° C.) to 800° F. (426° C.) range with 750° F. (398° C.) to 775° F. (412° C.) being most typical. Vacuum gas oil has an initial boiling point of 750° F. (398° C.) to 800° F. (426° C.) and an end point of 950° F. (510° C.) to 1100° F. (593° C.). The end point is defined by the hydrocarbon component distribution in the fraction as determined by an ASTM D-86 or ASTM D-1160 distillation. The naphtha, kerosene and diesel portion is referred to in the art collectively as distillate fuel. The gas oil and vacuum gas oil portion is referred to as fluid catalytic cracking (FCC) feedstock or as fuel oil blending stock.

Though a number of fractions can be made, those functionally equivalent to two essential fractions are considered to fall within the scope of this invention: a straight run naphtha fraction and a fraction comprising a mixture of the gas oil and vacuum gas oil.

The straight run naphtha fraction has heretofore been subjected to catalytic reforming to yield additional gasoline blending stock which has traditionally had a boiling range of 90° F. or 32° C. ($C_5$) to 430° F. (221° C.) with a 90 vol % distillation temperature of 335° F. (168° C.). A reduction in the 90 vol % distillation temperature has been shown to reduce the emission of carbon monoxide from gasoline fueled motor vehicles. It is therefore desirable to reduce the 90 vol % distillation temperature of gasoline to 310° F. (155° C.) or less, preferably 290° F. (143° C.).

A straight run naphtha is fractionated to remove the heaviest 5 vol % to 25 vol %, typically 10 vol % to 15 vol % to produce an intermediate naphtha fraction. It has been found that this intermediate naphtha fraction subjected to catalytic reforming produces a gasoline with the desired reduced 90 vol % distillation temperature. This 90 vol % distillation temperature is referred to in the art as the T90 temperature or T90 point. The T90 point is determined from an ASTM D-86 distillation of a sample of the fraction.

Accordingly, the straight run naphtha is fractionated to yield an intermediate naphtha fraction and a heavy naphtha fraction. The end point of the intermediate is nominally coincident with the initial boiling point of the heavy naphtha. In this regard, the separation is defined by the initial boiling point of the heavy naphtha fraction which is 250° F. (121° C.) or higher, preferably 275° F. (135° C.) or higher. End point of the heavy naphtha fraction is the same as the end point of the straight run naphtha fraction from which it is made.

The heavy naphtha is next heated and entirely vaporized to form a lift gas used to fluidize a cracking catalyst in a riser reactor. Commercial cracking catalysts for use in a fluid catalytic cracking (FCC) process have been developed to be highly active for the conversion of relatively heavy hydrocarbons such as gas oil and vacuum gas oil into naphtha, gasoline, lighter hydrocarbons such as $C_4$ olefins and coke. One class of such cracking catalysts includes those comprising zeolite silica-alumina molecular sieve in admixture with amorphous inorganic oxides such as alumina, silica-alumina, silica-magnesia and silica-zirconia.

This catalyst is regenerated in cyclic reuse according to the FCC process to maintain an ASTM D-3907 micro activity in the range of 60 to 72.

The heavy naphtha lift gas is combined with cracking catalyst in an initial portion of a vertically elongated riser reactor to produce a catalyst suspension. This is achieved with a lift gas velocity of about 1.0 to 18 meters per second up the riser. The velocity is controlled by the addition of high pressure fuel gas or steam to bring about the required catalyst suspension velocity. The catalyst to lift gas weight ratio is also adjusted, generally greater than 5:1 preferably greater than 80:1, most preferably 100:1 to 800:1.

Feedstock for fluid catalytic cracking is gas oil and vacuum gas oil. This feedstock is typically a straight run fraction from the pipe still. Additional sources of feedstock are the ebullated bed process or the delayed coker process which produces heavy distillate fractions by the catalytic hydrocracking or thermal cracking of heavy residual oil stocks.

The catalyst suspension is contacted with the FCC feedstock at a riser reactor temperature of 900° F. (482° C.) to 1200° F. (659° C.) at a pressure of 20 psia (1.36 atm) to 45 psia (3.06 atm) and a residence time of 0.5 to 5 seconds. The preferred riser reactor temperature is 950° F. (510° C.) to 1050° F. (565° C.) to achieve a higher conversion of gas oil and vacuum gas oil to liquid fuel and lighter. This liquid fuel and lighter fraction is subjected to fractionation to yield $C_3$, $C_4$ and $C_5$ olefins and a cracked naphtha.

Intermediate naphtha is subjected to catalytic reforming to yield reformed naphtha. Catalytic reforming is carried out using catalysts such as platinum-chlorinated alumina catalysts which have been developed to produce high yields and selectivity in increasing the octane number of selected hydrocarbon distillate stocks. The octane number is increased by aromatization of paraffin components and dehydrogenation of naphthenes to aromatics. This is carried out with a catalyst comprising a gamma alumina containing a single noble metal or combination of noble metals from Group VIII of the Periodic Table. The catalyst usually also contains at least one metal selected from the group consisting of rhenium, tin or germanium.

The catalytic reforming is carried out with pressure of 700 to 2750 kPa, weight hourly space velocity of 0.5 to 10 vol/hr/vol. and hydrogen to feed molar ratios of 2 to 15.

As a result of catalytic reforming a reformed naphtha product is recovered. On analysis, of this reformed naphtha, the initial boiling point is 90° F. or 32° C ($C_5$) and 90 vol % boils at a temperature of 310° F. (155° C.) or lower, typically 290° F. (143° C.) or lower.

The heavy naphtha fraction is used as fluid catalytic cracking (FCC) feedstock in the form of lift gas. The heavy naphtha fraction is contacted with a fluidized cracking catalyst at a riser reactor temperature of about 900° F. (482° C.) to 1200° F. (649° C.) to yield a liquid fuel and lighter fraction. The liquid fuel and lighter fraction is subjected to fractional distillation to yield a gasoline fraction and a fraction comprising predominantly $C_4$ olefins and lesser amounts of $C_3$ and $C_5$ olefins. There are two processes for converting these olefins to gasoline blending stocks. These olefins are reacted with an isoparaffin, such as isobutane, isopentane or mixture thereof, preferably isobutane in an acid catalyzed alkylation process to yield alkylate. Alkylate is used for gasoline blending to increase the octane of the motor gasoline pool. Alternatively, these olefins are reacted with methyl alcohol, ethyl alcohol or mixture thereof at etherification reaction conditions to form the ethers, methyl-t-butyl ether; t-amyl methyl ether; t-amyl ethyl ether, and ethyl-t-butyl ether all useful for blending in gasoline to increase octane.

It has been found, in Example 2, that the heavy naphtha fraction is not suitable when mixed with gas oil and vacuum gas oil as liquid feedstock for fluid catalytic cracking. The heavy naphtha fraction is converted instead according to the instant process to a $C_3$–$C_5$ olefin, gasoline precursor and cracked naphtha having a research octane suitable for blending in gasoline.

This invention is shown by way of Example.

EXAMPLE 1

A heavy straight run naphtha having a boiling range of 275° F. or 135° C. to 376° F. (191° C.) was subjected to fluid catalytic cracking in a pilot FCC unit having a feedstock capacity of 100 to 2000 cc/hr. Cracking was carried out by mixing heavy naphtha lift gas with nitrogen in a volumetric ratio of 1:2 to 2:1 and fluidizing the catalyst with the lift gas mixture. Two test runs were carried out.

In the first run at a riser outlet temperature of 1041° F. (560° C.) the conversion of heavy straight run naphtha to a product boiling at 90° F. or 32° C. ($C_5$) and lighter was 35.2 wt %. The conversion of heavy straight run naphtha to a product boiling at 250° F. (121° C.) and lighter was 42.93 wt %. Research octane number (RON) was increased from RON 36 to RON 68.3. The product was high in $C_3$–$C_5$ olefins.

In the second run at a riser outlet temperature of 1095° F. the conversion of heavy straight run naphtha to a product boiling at 90° F. ($C_5$) and lighter was 54.02 wt %. The conversion of heavy straight run naphtha to a product boiling at 250° F. (121° C.) and lighter was 62.57 wt %. Research octane number was increased from 36 RON to 86.5 RON. The product was higher in $C_3$–$C_5$ olefins.

Process conditions and product yields are reported in Table 1. In each case, although only heavy naphtha was cracked, the amount of catalyst circulated was the amount that would have been required if gas oil were also being cracked.

TABLE 1

| | HEAVY NAPHTHA FEED | PRODUCT | PRODUCT |
|---|---|---|---|
| Riser Outlet Temp., °F. | — | 1041.00 | 1095.00 |
| Adiabatic Jacket Temp., °F. | — | 960.00 | 1040.00 |
| Cat/Oil, gram/gram | — | 40.78 | 62.89 |
| Cat Circulation, gram/hr | — | 6625.00 | 10000.00 |
| Conversion to $C_5$−, Wt % | — | 35.20 | 54.02 |
| Conversion to 250° F.−, Wt % | — | 42.93 | 62.57 |
| Product Distribution, Wt % | | | |
| $H_2S$ | — | 0.00 | 0.00 |
| $H_2$ | — | 0.15 | 0.24 |
| $C_1$ | — | 1.16 | 2.45 |
| $C_2$ | — | 0.43 | 1.43 |
| $C_2$= | — | 2.70 | 5.17 |
| $C_3$ | — | 1.64 | 3.40 |
| $C_3$= | — | 9.60 | 14.29 |
| $iC_4$ | — | 3.36 | 5.10 |
| $nC_4$ | — | 0.91 | 1.67 |
| $iC_4$= | — | 1.62 | 2.02 |

TABLE 1-continued

| | HEAVY NAPHTHA FEED | PRODUCT | PRODUCT |
|---|---|---|---|
| $nC_4=$ | — | 4.55 | 5.43 |
| $C_4==$ | — | 0.00 | 0.00 |
| $iC_5$ | — | 2.41 | 3.11 |
| $nC_5$ | — | 0.36 | 0.40 |
| $C_5=$ | — | 3.43 | 3.36 |
| $C_5==$ | — | 0.00 | 0.00 |
| $C_5$–430° F. | 100.00 | 66.83 | 50.29 |
| $C_6$–430° F. | 100.00 | 60.60 | 43.42 |
| 250–430° F. | 97.50 | 52.87 | 34.86 |
| 430–670° F. | 0.00 | 4.20 | 2.57 |
| 670° F.+ | 0.00 | 0.00 | 0.00 |
| Coke | — | 2.86 | 5.95 |
| RON (ASTM D-2699) | 36.00 | 68.30 | 86.50 |
| MON (ASTM D-2700) | 42.20 | 61.80 | 76.20 |

EXAMPLE 2 (COMPARATIVE)

Example 1 was repeated. Heavy Naphtha was mixed with a gas oil and vacuum gas oil feedstock in an amount of 14 vol %. Lift gas was nitrogen. A significant amount of coke was produced and no product was recovered. The run was terminated.

EXAMPLE 3

A heavy straight run naphtha having a boiling range of 275° F. (135° C.) to 376° F. (191° C.) Was mixed with nitrogen in a volumetric ratio of 1:2 to 2:1 to produce a lift gas mixture for a pilot FCC unit having a feedstock rate of 100 to 2000 cc/hr. Feedstock was a liquid gas oil and vacuum gas oil mixture. The heavy naphtha was 14 wt % of total hydrocarbon.

Three test runs were carried out at riser outlet temperatures of 960° F. (515° C.), 1000° F. (538° C.) and 1040° F. (560° C.). Comparative runs were carried out at the same conditions with pure nitrogen lift gas. For each pair of test runs, the net conversion (Y) from the heavy naphtha was calculated according to the formula:

$$Y(\text{heavy naphtha}) = \frac{Y(\text{total hydrocarbon}) - 0.86Y(\text{gas oil} + \text{vacuum gas oil})}{0.14}$$

Results are reported in Tables 2, 3 and 4. Hydrocarbon feedstock properties ar reported in Table 5.

The calculated numbers shown in Tables 2, 3 and 4 are the octane numbers which would have been obtained if the uncracked heavy naphtha had been blended with the fluid catalytic cracked (FCC) naphtha produced from cracking the vacuum gas oil alone as shown in the first column of each table. As can be seen, using the heavy naphtha as lift gas produced a cracked naphtha with significantly higher octane number. Although conversion and octane number improvement are not as good as when cracking heavy naphtha alone, the improvements are substantial.

While particular embodiments of the invention have been described, it will be understood, of course, that the invention is not limited thereto since many modifications may be made, and it is, therefore, contemplated to cover by the appended claims any such modification as fall within the true spirit and scope of the invention.

TABLE 2

| | Gas Oil* Cracking/$N_2$ Lift Gas | Gas Oil*/ Heavy Naphtha Lift Gas | Calculated Y(Heavy) Naphtha) |
|---|---|---|---|
| Riser Outlet Temp., °F. | 960.00 | 960.00 | |
| Adiabatic Jacket Temp., °F. | 960.00 | 960.00 | |
| Cat/Oil, gram/gram | 6.79 | 6.86 | |
| Cat Circulation, gram/hr | 6181.00 | 6339.00 | |
| Gas Oil Feed Rate, gram/hr | 909.64 | 923.55 | |
| Heavy Naphtha Rate, gram/hr | 0.00 | 159.58 | |
| Conversion, Wt % | 69.03 | 74.32 | |
| Conversion to $C_5$–, Wt % | | | 19.72 |
| Conversion to 250° F.–, Wt % | | | 27.74 |
| Product Distribution, Wt % | | | |
| $H_2S$ | 1.24 | 1.18 | 0.80 |
| $H_2$ | 0.14 | 0.12 | 0.00 |
| $C_1$ | 1.18 | 1.03 | 0.16 |
| $C_2$ | 0.85 | 0.82 | 0.62 |
| $C_2=$ | 0.79 | 0.77 | 0.62 |
| $C_3$ | 1.04 | 1.01 | 0.80 |
| $C_3=$ | 4.32 | 4.25 | 3.67 |
| $iC_4$ | 2.48 | 2.39 | 1.78 |
| $nC_4$ | 0.60 | 0.57 | 0.38 |
| $iC_4=$ | 1.45 | 1.42 | 1.19 |
| $nC_4=$ | 3.76 | 3.64 | 2.81 |
| $C_4==$ | 0.04 | 0.03 | −0.03 |
| $iC_5$ | 2.36 | 2.30 | 1.86 |
| $nC_5$ | 0.28 | 0.27 | 0.20 |
| $C_5=$ | 4.73 | 4.58 | 3.54 |
| $C_5==$ | 0.07 | 0.04 | −0.13 |

TABLE 2-continued

| | Gas Oil* Cracking/$N_2$ Lift Gas | Gas Oil*/ Heavy Naphtha Lift Gas | Calculated Y(Heavy) Naphtha) |
|---|---|---|---|
| $C_5$–430° F. | 45.50 | 52.05 | 85.83 |
| $C_6$–430° F. | 38.06 | 44.85 | 80.28 |
| 250–430° F. | 23.49 | 31.19 | 72.26 |
| 430–670° F. | 20.04 | 17.07 | |
| 670° F.+ | 10.93 | 8.61 | |
| Coke | 5.70 | 5.08 | 1.43 |
| RON | 89.9 | 82.0 | 53.7 |
| MON | 80.6 | 75.6 | 62.7 |
| RON (Calculated) | | 74.9 | |
| MON (Calculated) | | 68.5 | |

*Gas Oil and Vacuum Gas Oil

TABLE 3

| | Gas Oil* Cracking/$N_2$ Lift Gas | Gas Oil*/ Heavy Naphtha Lift Gas | Calculated Y(Heavy) Naphtha) |
|---|---|---|---|
| Riser Outlet Temp., °F. | 1000.00 | 1000.00 | |
| Adiabatic Jacket Temp., °F. | 1000.00 | 1000.00 | |
| Cat/Oil, gram/gram | 8.93 | 7.49 | |
| Cat Circulation, gram/hr | 8108.00 | 8063.00 | |
| Gas Oil Feed Rate, gram/hr | 907.48 | 930.78 | |
| Heavy Naphtha Rate, gram/hr | 0.00 | 145.20 | |
| Conversion, Wt % | 74.06 | 77.04 | |
| Conversion $C_5$–, Wt % | | | 20.39 |
| Conversion 250° F.–, Wt % | | | 34.82 |
| Product Distribution, Wt % | | | |
| $H_2S$ | 1.42 | 1.19 | −0.30 |
| $H_2$ | 0.16 | 0.16 | 0.17 |
| $C_1$ | 1.50 | 1.43 | 1.02 |
| $C_2$ | 1.18 | 1.18 | 1.23 |
| $C_2$= | 1.07 | 1.14 | 1.66 |
| $C_3$ | 1.34 | 1.37 | 1.63 |
| $C_3$= | 5.69 | 5.50 | 4.46 |
| $iC_4$ | 3.00 | 2.80 | 1.58 |
| $nC_4$ | 0.78 | 0.78 | 0.81 |
| $iC_4$= | 1.67 | 1.56 | 0.89 |
| $nC_4$= | 4.66 | 4.38 | 2.69 |
| $C_4$== | 0.05 | 0.05 | 0.05 |
| $iC_5$ | 2.92 | 2.77 | 1.88 |
| $nC_5$ | 0.36 | 0.40 | 0.68 |
| $C_5$= | 5.23 | 4.67 | 1.13 |
| $C_5$== | 0.06 | 0.07 | 0.14 |
| $C_5$–430° F. | 44.44 | 49.26 | 83.51 |
| $C_6$–430° F. | 35.88 | 41.35 | 79.61 |
| 250–430° F. | 21.96 | 27.44 | 65.18 |
| 430–670° F. | 17.52 | 15.96 | |
| 670° F.+ | 8.43 | 7.00 | |
| Coke | 7.16 | 6.28 | 0.67 |
| RON | 93.5 | 86.4 | 56.1 |
| MON | 82.1 | 77.8 | 64.6 |
| RON (Calculated) | | 79.2 | |
| MON (Calculated) | | 69.7 | |

*Gas Oil and Vacuum Gas Oil

TABLE 4

| | Gas Oil* Cracking/$N_2$ Lift Gas | Gas Oil*/ Heavy Naphtha Lift Gas | Calculated Y(Heavy) Naphtha) |
|---|---|---|---|
| Riser Outlet Temp., °F. | 1040.00 | 1040.00 | |
| Adiabatic Jacket Temp., °F. | 1040.00 | 1040.00 | |
| Cat/Oil, gram/gram | 10.93 | 9.46 | |
| Cat Circulation, gram/hr | 10025.00 | 10237.00 | |
| Gas Oil Feed Rate, gram/hr | 917.53 | 920.77 | |
| Heavy Naphtha Rate, gram/hr | 0.00 | 161.80 | |
| Conversion, Wt % | 76.90 | 80.84 | |
| Conversion $C_5$–, Wt % | | | 32.62 |
| Conversion 250° F.–, Wt % | | | 40.89 |
| Product Distribution, Wt % | | | |
| $H_2S$ | 1.39 | 1.32 | 0.90 |
| $H_2$ | 0.18 | 0.16 | 0.05 |
| $C_1$ | 1.88 | 1.74 | 0.92 |
| $C_2$ | 1.48 | 1.34 | 0.53 |
| $C_2$= | 1.38 | 1.43 | 1.66 |
| $C_3$ | 1.54 | 1.60 | 1.88 |

TABLE 4-continued

| | Gas Oil* Cracking/$N_2$ Lift Gas | Gas Oil*/ Heavy Naphtha Lift Gas | Calculated Y(Heavy) Naphtha) |
|---|---|---|---|
| $C_3$= | 6.58 | 6.80 | 7.82 |
| $iC_4$ | 3.06 | 3.22 | 4.01 |
| $nC_4$ | 0.85 | 0.89 | 1.08 |
| $iC_4$= | 1.89 | 1.83 | 1.45 |
| $nC_4$= | 5.13 | 5.13 | 4.98 |
| $C_4$== | 0.06 | 0.04 | −0.07 |
| $iC_5$ | 2.90 | 2.95 | 3.14 |
| $nC_5$ | 0.35 | 0.36 | 0.40 |
| $C_5$= | 5.48 | 5.31 | 4.23 |
| $C_5$== | 0.08 | 0.06 | −0.05 |
| $C_5$−430° F. | 43.37 | 48.47 | 75.20 |
| $C_6$−430° F. | 34.58 | 39.79 | 67.38 |
| 250–430° F. | 20.78 | 26.78 | 59.11 |
| 430–670° F. | 16.03 | 13.28 | |
| 670° F.+ | 7.03 | 5.87 | |
| Coke | 8.18 | 6.91 | −0.30 |
| RON | 95.3 | 88.0 | 57.20 |
| MON | 81.4 | 79.1 | 72.50 |
| RON (Calculated) | | 79.4 | |
| MON (Calculated) | | 68.0 | |

*Gas Oil and Vacuum Gas Oil

TABLE 5

| FEED PROPERTIES | GAS OIL* | HEAVY NAPHTHA |
|---|---|---|
| API Gravity | 21.4° | 48.9° |
| Aniline Point, °F. | 163 | 115 |
| Bromine No. | 16.6 | 15.6 |
| Olefins, Vol % | — | 1.9 |
| Watson Aromatics, Wt % | 60.8 | 40.7 |
| X-Ray Sulfur, Wt % | 2.517 | 0.1084 |
| Basic $N_2$, wppm | 412 | — |
| Total $N_2$, wppm | 1949 | 4.83 |
| Micro Carbon Residue, Wt % | 0.68 | — |
| RON | — | 36 |
| MON | — | 42.2 |
| Distillation | ASTM D-1160 | ASTM D-86 |
| IBP (initial boiling point) | 546° F. | 275° F. |
| 5 | 645 | 299 |
| 10 | 680 | 300 |
| 20 | 723 | 303 |
| 30 | 761 | 306 |
| 40 | 805 | 310 |
| 50 | 834 | 314 |
| 60 | 868 | 318 |
| 70 | 905 | 324 |
| 80 | 950 | 331 |
| 90 | 1003 | 344 |
| 95 | 1046 | 363 |
| EP (end point) | 1078 | 376 |
| Metal, wppm | | |
| Al | <1.0 | — |
| Fe | 4.1 | — |
| Na | 1.7 | — |
| Ni | <1.0 | — |
| V | <1.0 | — |

*Gas Oil and Vacuum Gas Oil

What is claimed is:

1. A process for catalytically cracking a heavy naphtha fraction derived from crude petroleum to yield a cracked naphtha and a $C_3$ to $C_5$ olefin fraction comprising:

a. fractionating crude petroleum to produce at least two fractions comprising:

i. a straight run naphtha fraction having a boiling range of about 90° F. (32.2° C.) to 430° F. (221° C.), and ii. a gas oil and vacuum gas oil fraction having a boiling range of about 650° F. (343° C.) to 1100° F. (593° C.);

b. fractionating the straight run naphtha fraction to produce at least two fractions comprising:

i. an intermediate naphtha fraction, and ii. a heavy naphtha fraction having an initial boiling point of about 250° F. (121° C.) or higher;

c. vaporizing the heavy naphtha fraction to yield a lift gas;

d. contacting fluid catalytic cracking catalyst with the lift gas in an initial portion of a vertically elongated riser reactor to produce a catalyst suspension;

e. contacting the catalyst suspension with the gas oil and vacuum gas oil fraction at a riser reactor temperature of about 900° F. (482° C.) to 1200° F. (649° C.) to yield a liquid fuel and lighter fraction;

f. fractionating the liquid fuel and lighter fraction to yield a $C_3$ to $C_5$ olefin fraction and cracked naphtha;

g. catalytically reforming the intermediate naphtha fraction of step b.i. at catalytic reforming conditions to yield reformed naphtha characterized in having 90 vol % boiling at a temperature of 310° F. (155° C.) or lower.

2. The process of claim 1 wherein in step b. the heavy naphtha fraction comprises 5 vol % to 25 vol % of the straight run naphtha fraction.

3. The process of claim 1 wherein in step b. the heavy naphtha fraction comprises 10 vol % to 15 vol % of the straight run naphtha fraction.

4. The process of claim 1 wherein in step b. the heavy naphtha initial boiling point is 275° F. (135° C.) or higher.

5. The process of claim 1 wherein in step e. the riser reaction temperature is about 950° F. (510° C.) to 1050° F. (565° C.).

6. The process of claim 1 wherein in step g. the reformed naphtha is characterized in having 90 vol % boiling at a temperature of about 290° F. (143° C.) or lower.

7. The process of claim 1 wherein the lift gas comprises heavy naphtha fraction and nitrogen.

8. The process of claim 1 wherein the lift gas comprises heavy naphtha fraction and nitrogen in a volumetric ratio of 1:2 to 2:1.

9. The process of claim 1 additionally comprising contacting the $C_3$ to $C_5$ olefin fraction of step f. with an isoparaffin selected from the group consisting of isobutane, isopentane and mixtures thereof at alkylation reaction conditions to yield alkylate useful for blending with gasoline.

10. The process of claim 1 additionally comprising contacting the $C_3$ to $C_5$ olefin fraction of step f. with an alcohol selected from the group consisting of methyl alcohol, ethyl alcohol and mixtures thereof at etherification reaction conditions to yield an ether useful for blending with gasoline.

11. A process for catalytically cracking a heavy naphtha fraction derived from crude petroleum to yield a cracked naphtha and a $C_3$ to $C_5$ olefin fraction comprising:

a. fractionating crude petroleum to produce a straight run naphtha fraction having a boiling range of about 90° F. (32.2° C.) to 430° F. (221° C.);

b. fractionating the straight run naphtha fraction to produce at least two fractions comprising:

i. an intermediate naphtha fraction, and ii. a heavy naphtha fraction having an initial boiling point of about 250° F. (121° C.) or higher;

c. contacting a fluidized cracking catalyst with the heavy naphtha fraction at a riser reactor temperature of about 900° F. (482° C.) to 1200° F. (649° C.) to yield a liquid fuel and lighter fraction;

d. fractionating the liquid fuel and lighter fraction to yield a $C_3$ to $C_5$ olefin fraction and cracked naphtha;

e. catalytically reforming the intermediate naphtha fraction of step b.i. at catalytic reforming conditions to yield reformed naphtha characterized in having 9 vol % boiling at a temperature of 310° F. (155° C.) or lower.

12. The process of claim 11 wherein in step b. the heavy naphtha fraction initial boiling point is 275° F. (135° C.) or higher.

13. The process of claim 11 wherein in step c. the riser reactor temperature is about 950° F. (510° C.) to 1050° F. (565° C.).

14. The process of claim 11 wherein in step e. the reformed naphtha is characterized in having 90 vol % boiling at a temperature of 290° F. (143° C.) or lower.

15. The process of claim 11 additionally comprising contacting the $C_3$ to $C_5$ olefin fraction of step d. with an isoparaffin selected from the group consisting of isobutane, isopentane and mixtures thereof at alkylation reaction conditions to yield alkylate useful for blending with gasoline.

16. The process of claim 11 additionally comprising contacting the $C_3$ to $C_5$ olefin fraction of step d. with an alcohol selected from the group consisting of methyl alcohol, ethyl alcohol and mixtures thereof at etherification reaction conditions to yield an ether useful for blending with gasoline.

* * * * *

UNITED STATES PATENT AND TRADEMARK OFFICE

CERTIFICATE OF CORRECTION

PATENT NO. : 5,318,689

DATED : June 7, 1994

INVENTOR(S) : Hsu-Hui (NMN) Hsing
Roy Earl Pratt

It is certified that error appears in the above-indentified patent and that said Letters Patent is hereby corrected as shown below:

In Claim 11, column 14, line 7, delete "9" and insert therefor --90--.

Signed and Sealed this

Twentieth Day of September, 1994

*Attest:*

Bruce Lehman

BRUCE LEHMAN

*Attesting Officer*

*Commissioner of Patents and Trademarks*